US009321233B2

(12) United States Patent
Ehrmann

(10) Patent No.: US 9,321,233 B2
(45) Date of Patent: Apr. 26, 2016

(54) THERMOFORMING PACKAGING MACHINE

(71) Applicant: MULTIVAC SEPP HAGGENMÜLLER GMBH & CO. KG, Wolfertschwenden (DE)

(72) Inventor: Elmar Ehrmann, Bad Grönenbach (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 0 days.

(21) Appl. No.: 14/351,129

(22) PCT Filed: Oct. 11, 2012

(86) PCT No.: PCT/EP2012/004271
§ 371 (c)(1),
(2) Date: Apr. 10, 2014

(87) PCT Pub. No.: WO2013/053484
PCT Pub. Date: Apr. 18, 2013

(65) Prior Publication Data

US 2014/0249007 A1 Sep. 4, 2014

(30) Foreign Application Priority Data

Oct. 12, 2011 (DE) ..... 10 2011 115 881

(51) Int. Cl.
*B31B 17/74* (2006.01)
*B65B 41/14* (2006.01)
*B65H 20/16* (2006.01)
(Continued)

(52) U.S. Cl.
CPC . *B31B 17/74* (2013.01); *B65B 9/04* (2013.01); *B65B 41/14* (2013.01); *B65H 20/16* (2013.01); *B65H 23/038* (2013.01);
(Continued)

(58) Field of Classification Search
CPC ..... B31B 17/74; B31B 2217/082; B31B 2217/068; B31B 2217/00; B65B 9/04; B65B 41/14; B65H 20/16; B65H 23/038
USPC ..... 198/626.1, 850, 851, 852, 853
See application file for complete search history.

(56) References Cited

U.S. PATENT DOCUMENTS 3,673,760 A * 7/1972 Canamero et al. ..... 53/433
3,738,556 A * 6/1973 Grebe ..... 226/173
(Continued)

FOREIGN PATENT DOCUMENTS

CN 1319537 A 10/2001
CN 1671594 A 9/2005
(Continued)

*Primary Examiner* — Sameh Tawfik
(74) *Attorney, Agent, or Firm* — Husch Blackwell LLP

(57) ABSTRACT

A thermo-forming packaging machine having a machine frame and a film advance device for gripping one side of a film web and for transporting the film web through one or more workstations in the thermo-forming packaging machine. The film advance device may be provided only on one side of the machine frame allowing the present packaging machine to utilize packaging film webs of different widths. The thermo-forming packaging machine may also include an alignment device to align an edge of the packaging film with the film advance device. The thermo-forming packaging machine may also include one or more counter supports to prevent the film from being displaced by a forming tool lower part of the forming station.

11 Claims, 3 Drawing Sheets

(51) Int. Cl.
*B65B 9/04* (2006.01)
*B65H 23/038* (2006.01)

(52) U.S. Cl.
CPC ..... *B65H 2301/4422* (2013.01); *B65H 2301/4493* (2013.01); *B65H 2701/1752* (2013.01); *B65H 2801/81* (2013.01)

(56) References Cited

U.S. PATENT DOCUMENTS

| | | | | | |
|---|---|---|---|---|---|
| 4,627,319 | A | * | 12/1986 | Mattei et al. | 83/73 |
| 5,774,777 | A | * | 6/1998 | Ohtsuka et al. | 399/384 |
| 5,954,914 | A | * | 9/1999 | Aihara | 156/361 |
| 6,282,866 | B1 | * | 9/2001 | Natterer et al. | 53/282 |
| 8,985,423 | B2 | * | 3/2015 | Ehrmann et al. | 226/172 |
| 2003/0106777 | A1 | * | 6/2003 | Davis et al. | 198/494 |
| 2003/0213867 | A1 | * | 11/2003 | Yomeoka | 242/615.1 |
| 2003/0230619 | A1 | * | 12/2003 | Le Viavant | 226/196.1 |
| 2005/0056720 | A1 | * | 3/2005 | Natterer | 242/564.3 |
| 2012/0283083 | A1 | * | 11/2012 | Ehrmann | 493/199 |
| 2014/0158502 | A1 | * | 6/2014 | Kurz | 198/850 |

FOREIGN PATENT DOCUMENTS

| | | | | |
|---|---|---|---|---|
| CN | 101613000 | A | | 12/2009 |
| DE | 1080477 | B | | 4/1960 |
| DE | 1132403 | B | | 6/1962 |
| DE | 2000618 | A1 | | 11/1970 |
| DE | 102008051026 | A1 | | 4/2010 |
| DE | 102010053444 | A1 | | 6/2012 |
| EP | 0126878 | A1 | | 12/1984 |
| EP | 3716673 | A1 | * | 11/1987 |
| EP | 1816075 | A1 | | 8/2007 |
| GB | 1211073 | | | 11/1970 |
| JP | 5416797 | B2 | | 2/2014 |

* cited by examiner

THERMOFORMING PACKAGING MACHINE

FIELD OF THE INVENTION

The invention relates to a thermo-forming packaging machine with a film advance device for gripping and transporting one side of a film web.

BACKGROUND OF THE INVENTION

Thermo-forming packaging machines are known from the applicant's EP 0 126 878 A1 and EP 1 816 075 A1 in which a film web is gripped with two clamping chains that are arranged on both sides of the film web and intermittently transported by the thermo-forming packaging machine. The width of the machine is determined by the width of the film web to be transported, or vice versa. The drawback of thermo-forming packaging machines having clamping chains arranged on two sides is that only a single film web width can be used corresponding to the distance of the clamping chains from each other, as conversion of the machine to a different film web width would entail an enormous effort and is technically very difficult to realize.

SUMMARY OF THE INVENTION

The object of the present invention is to provide a possibility of being able to transport and process film webs with different film widths on a thermo-forming packaging machine.

The thermo-forming packaging machine according to the invention may comprise a machine frame aligned in a direction of transport for a film web having a first and a second side, and a film advance device for gripping one side of the film web and for transporting the film web, wherein the film advance device is provided only on one side of the machine frame. Such single-side film advance may allow the use of film webs of various widths with a maximum width that is determined by the spacing of the two sides of the machine frame. By using arbitrarily selectable film web widths, film material can be saved because firstly, no film edge for another film advance device needs to be provided, and secondly, the film web width can be precisely adapted to the space required for the desired packaging size. The costs of film consumption per package are an important cost factor for the production costs, in particular with rigid films and multilayer films.

It was extremely surprising and unexpected for the person skilled in the art that a single-side film advance device is sufficient for the thermo-forming packaging machine according to the present invention, because the person skilled in the art had to date always assumed that a film web must be tensioned on both sides. The present invention overcomes the prejudice that symmetrical two-sided gripping of the film web is required to ensure reliable distortion-free transport of a film web in a thermo-forming packaging machine.

In an advantageous embodiment, a device for web edge guidance may be provided for position control of the film web relative to the film advance device in order to precisely feed one side of the film web to be gripped to the film advance device, so that reliable transport can be ensured.

Preferably, the device for web edge guidance may comprise a roller that is pivotable relative to the film advance device and driven, for example, by a servomotor. The film web, being unwound from a feed reel, runs over this roller prior to being approached to the film advance device. By changing the position of the roller, a lateral motion of the film web can be generated relative to the film advance device or the machine frame, respectively, and the film web can be guided respectively or one side of the film web can be positioned accordingly. One variant is also conceivable in which at least two rollers may be connected together with a frame which in turn is designed pivotable relative to the film advance device.

Preferably, a thermo-forming packaging machine according to the invention may comprise one or more film counter supports for the film web that are provided upstream and/or downstream of a workstation, for example a molding or sealing station. When opening a workstation, adhesion due to negative pressure between trays formed in the film web and a tool lower part can occur, and the film web can tend to be at least partially drawn downwardly by the tool lower part. The film counter supports may hold the film web in its transporting plane and assist detachment of the trays from the tool lower part. This may prevent the film web to be drawn downwardly by the lower tool part, in particular in the area that is not supported by the film advance device.

In an advantageous further development, a clamping device may be provided for clamping the film web onto the film counter support, particularly in areas close to the work station, in order to prevent the film web from being drawn downwardly by the tool lower part when opening the workstation.

Preferably, an auxiliary transport device may be provided for supporting the single-side film transport by the film advance device. A top film may be sealed onto the film web with the molded trays at the sealing station. The top film may be drawn from a material storage in that the film transport by the film advance device draws the top film sealed onto the film web along in the direction of transport. This increases the tensile forces onto the film web, and the risk of wrinkles being formed in the film increases in the region of the film web located across from the film advance device. Wrinkles may be reduced by the auxiliary transport device.

Preferably, the auxiliary transport device for transporting a top film may be provided upstream of the sealing station, so that no additional tensile forces act upon the film web and wrinkling of the film web and/or the top film may be prevented.

The auxiliary transport device preferably comprises a clamping chain for transporting the top film synchronously with the film web wherein the auxiliary transport device may also be able to transport different widths of top films. A device for web edge guidance may also be located upstream of such a single-side clamping chain advance to feed the position of one side of the top film precisely to the clamping chain of the auxiliary transport device.

In one advantageous variant, a tray advancer (or tray pusher) may be disposed downstream of the sealing station to prevent wrinkling due to tensile forces experienced in the cover film.

Preferably, the package trays, using such a tray advancer, may be advanced by the film advance device from the underside of the film web in synchronism with the film transport. The tray advancer may comprise slide elements extending transversely to the direction of transport across all adjacently disposed tracks of packages and that may engage the package trays.

In a preferred embodiment of a thermo-forming packaging machine according to the invention, the side of the machine frame located opposite to the film advance device may be open in the region of a workstation in order to be able to move tools of the work station horizontally transverse to the direction of transport. This allows removal of tools for maintenance or cleaning purposes without the film web having to be cut out or off. Furthermore, there are no conversion measures necessary since only side panels need to be removed or opened to move or exchange tools. The workstations can be a forming, sealing or cutting station. A forming tool upper part, forming tool lower part, sealing tool upper part, sealing tool lower part etc. are to be considered as being tools. Appropriate tools are preferably to be employed according to the use of different film web widths; therefore, a simple change of these tools is a particular advantage. The side of the machine frame disposed opposite to the film advance device may be interrupted or partially opened only for the space required.

Preferably, the film web being provided for processing in a thermo-forming packaging machine described above may be at least 200 μm thick, preferably at least 250 μm.

Preferably, the film advance device may be designed as a clamping chain. Alternatively, the film advance device may grip the film web and fasten it laterally, for example, using pins.

Also conceivable is the use of two or more film advance devices or clamping chains for transporting a web film, wherein the film advance devices may be provided consecutively on one side of the machine frame.

Other aspects and advantages of the present invention will be apparent from the following detailed description of the preferred embodiments and the accompanying drawing figures.

DESCRIPTION OF THE SEVERAL VIEWS OF THE DRAWING

The accompanying drawings form a part of the specification and are to be read in conjunction therewith, in which like reference numerals are employed to indicate like or similar parts in the various views.

DETAILED DESCRIPTION OF THE INVENTION

Figure 1:
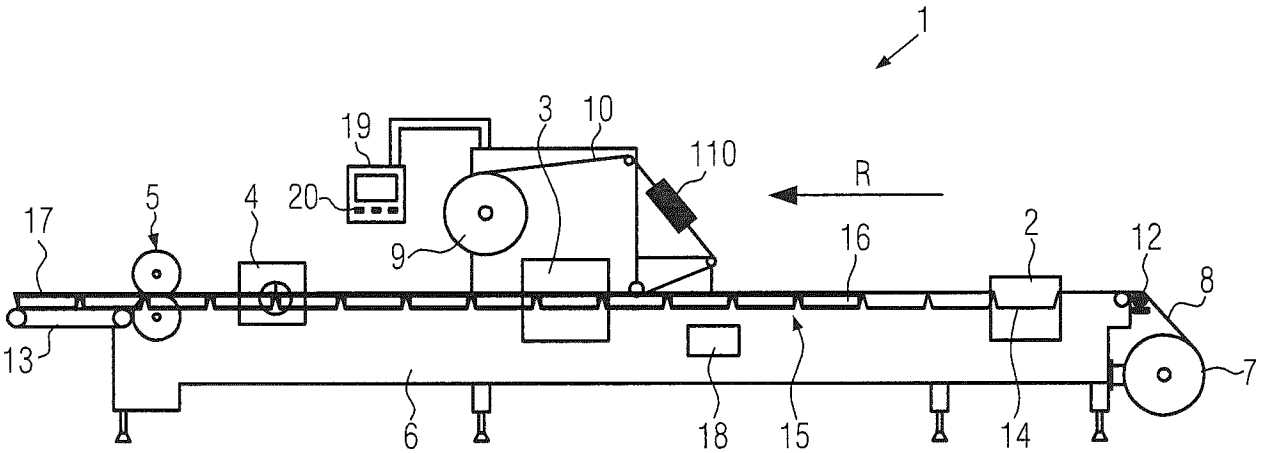
FIG. 1 is a schematic side view of one embodiment of a thermo-forming packaging machine in accordance with the teachings of the present disclosure.

The invention will now be described with reference to the drawing figures. For purposes of clarity in illustrating the characteristics of the present invention, proportional relationships of the elements have not necessarily been maintained in the drawing figures.

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

Figure 2:
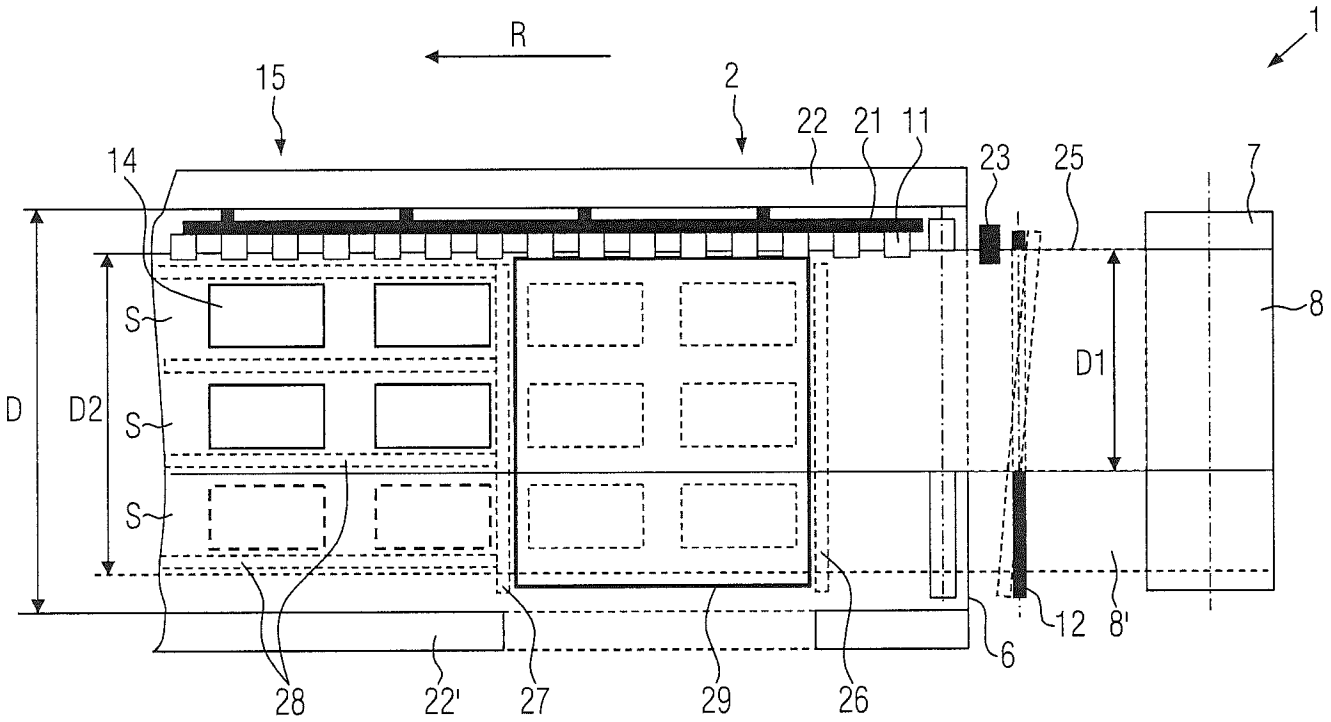
FIG. 2 is a schematic top plan view of a front portion of the thermo-forming packaging machine of FIG. 1.
Figure 3:
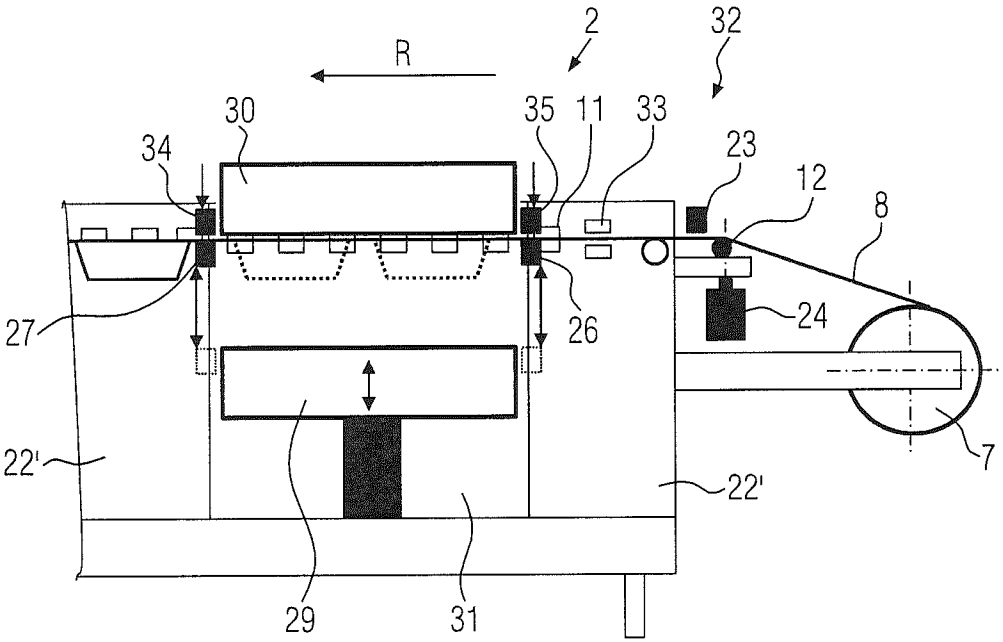
FIG. 3 is a schematic side view of the front portion of the thermo-forming packaging machine of FIG. 1.

FIG. 1 shows a schematic view of a thermo-forming packaging machine 1 according to one embodiment of the present invention. This thermo-forming packaging machine 1 comprises a forming station 2, a sealing station 3, a transverse cutting device 4 and a longitudinal cutting device 5, which are arranged in this sequence in a direction of production R on a machine frame 6. The machine frame 6 comprises a feed reel 7 disposed on the inlet side from which a first film web 8 is drawn off. In the region of the sealing station 3, a material storage 9 is provided from which a top film 10 is drawn off. In this, an auxiliary transport device 110 is provided for the top film 10 between the material storage 9 and the sealing station 3. The thermo-forming packaging machine 1 comprises a discharge device 13 on the outlet side in the form of a transport belt with which the fully separated packages 17 are removed. Furthermore, the thermo-forming packaging machine 1 comprises a film advance device which grips the film web 8 and transports it on with every main processing cycle in the direction of transport R. The film advance device is presently embodied by a transport chain 11 (see FIGS. 2 and 3) disposed only on a single side at the film web 8. As shown in FIGS. 2 and 3, a device 12 for web edge guidance for the film web 8 is arranged between the feed reel 7 and the clamping chain 11.

Now turning back to FIG. 1, in the embodiment illustrated, the forming station 2 is embodied as a thermo-forming station in which trays 14 are formed into the film web 8 after it has been heated by a heater, not shown. In this, the forming station 2 can be designed such that several trays are formed adjacently in the direction transverse to the direction of processing R as shown in FIG. 2. In the direction of processing R downstream of the forming station 2, a loading stretch 15 is provided in which the trays 14 formed into the film web 8 are filled with product 16.

The sealing station 3 has a sealable chamber in which the atmosphere in the trays 14 can, e.g. by flushing with a gas, be replaced with an exchange gas or a gas mixture prior to sealing.

The transverse cutting device 4 is designed as a punch that severs the film web film 8 and the top film 10 between adjacent trays 14 in a direction transverse to the direction of processing R. The transverse cutting device 4 operates in such a manner that the film web 8 is not severed across the entire width, but is not cut at least in an edge region. This allows continued transport of the film web 8 with the top film 10 in a controlled manner by the film advance device.

The longitudinal cutting device 5 is in the illustrated embodiment configured as a blade assembly with which the film web 8 and the top film 10 are cut between adjacent trays 14 and at the side edge of the film 8, so that separated packages 17 are given downstream of the longitudinal cutting device 5.

The thermo-forming packaging machine 1 also comprises a control unit 18. It serves the purpose of controlling and monitoring the processes running in the thermo-forming packaging machine 1. A display device 19 with controls elements 20 is used for visualizing or influencing the processes in the packaging machine 1 for or by an operator, respectively.

The general mode of operation of the thermo-forming packaging machine 1 shall be described briefly below.

As shown in FIGS. 2 and 3, the film web 8 is drawn from the feed reel 7 and fed along a device 12 for web edge guidance to the clamping chain 11 disposed on a single side. The device 12 ensures that one side of the film web 8 is fed to the clamping chain 11 such that the clamping chain 11 securely grips the film web 8 and reliably transports it intermittently through the thermo-forming packaging machine 1 in the direction of transport R. As best shown in FIG. 1, the film web 8 is transported into the forming station 2, and trays 14 are therein formed in the film web 8 by thermo-forming. The trays 14 are together with the surrounding area of the film web 8 further transported in a main processing cycle to the loading stretch 15 in which they are filled with product 16.

As further shown in FIG. 1, the filled trays 14 together with the surrounding area of the film web 8 are then transported in a main processing cycle through the film advance device into the sealing station 3. Following a sealing process onto the film web 8, the top film 10 is further transported with the advance motion of the film web 8. In this, the top film 10, assisted by an auxiliary transport device 110, is drawn off the material storage 9. By sealing the top film 10 onto the trays 14, sealed packages 17 are created that are separated in the subsequent cuts 4 and 5 and with the discharge device 13 removed from the thermo-forming packaging machine 1. Instead of the transverse 4 and longitudinal cut 5, a complete cutting tool (not shown) can also be provided which cuts out packages 17 in a single cutting operation.

FIG. 2 shows a partial view of the front portion of a thermo-forming packaging machine 1 from the feed reel 7 to the loading stretch 15 in a schematic plan view. The thermo-forming packaging machine 1 comprises only a single clamping chain 11 as a film advance device which is attached with a chain guide 21 at a first side 22 of the machine frame 6. The oppositely disposed second side 22' of the machine frame 6 is arranged at a distance D parallel to the first side 22 and is partially recessed in the region of the forming station 2. The thermo-forming packaging machine 1 allows various film web widths D1 and D2 to be processed, as the film webs 8 or 8' are always gripped and transported only at the first side 22 of the machine frame 6 by the clamping chain 11. The device 12 in the form of a roller (later also designated by 12) for web edge guidance is pivotally attached to the machine frame 6. A sensor 23 detects the position of one side of the film web 8 and forwards that information to the control unit 18. The control unit 18 controls the position of the roller 12 using a servo motor 24 (see FIG. 3) so that the side 25 of the film web 8 can be adjusted relative to the clamping chain 11 by pivoting or a changing the position of the roller 12 in order to ensure that the film web 8 is reliably gripped by the clamping chain 11. Film webs 8' with a different, for example, greater film web width D2 can also be used as long as they are not wider than the spacing D of the sides 22, 22' of the machine frame 6.

As shown in FIGS. 2 and 3, immediately up- and downstream of the forming station 2, strip-shaped film counter supports 26 and 27 are provided vertically movable directly below the film web 8. In their upper position directly below the film web 8, the film counter supports 26, 27 hold the film web 8 after the forming process in this upper position so that, during a motion of a forming tool lower part 29 when opening the forming station 2, the film web 8 is not by adhesion of the form trays 14 to the forming tool lower part 29 drawn along downwardly and the film web 8 can detach more easily and quickly from the forming tool lower part 29.

As shown in FIG. 2, strip-shaped film supports 28 oriented in the direction of transport R are as a support of the film web 8 disposed between or adjacent to the tracks S of the package trays 14 directly below the film web 8.

FIG. 3 is a schematic side view of the front portion of packaging machine 1 and shows the forming tool lower part 29 and a forming tool upper part 30 of the forming station 2. The film counter supports 26, 27 are vertically movable and remain in their upper position until the forming tool lower part 29 has performed at least a portion of its vertical motion in a downwardly direction. The film counter supports 26, 27 then follow this vertical motion in order to again quickly clear for an advance motion of the molded trays 14 or the film web 8, respectively. Clamping devices 34, 35 are provided opposite to the film counter supports 26, 27 on the respective other side of the film web 8 and clamp the film web 8 against the film counter supports 26, 27 when the latter are in their upper position directly below the film web 8. The clamping devices 34, 35 can with a membrane exert a clamping force against the film counter supports 26, 27, or the film counter supports 26, 27 create a clamping force against statically attached clamping devices 34, 35 that can be located directly on the upper side of the film web 8.

It is shown in FIG. 3 that the second side 22' of the machine frame 6 located opposite to the clamping chain 11 comprises a recess 31 to allow a motion of the forming tools 29, 30 in the direction (out of the drawing plane) transversely to the direction of transport R in order to facilitate tool exchange or maintenance or cleaning of the tools 29, 30. As further shown in FIG. 3, in the region of a film inlet 32, a first clamp 33 of the clamping chain 11 is not yet sufficiently closed such that would clamp the film web 8. With the advance motion of the clamping chain 11 in the direction of transport R, the clamp 33 closes and grips the film web 8. Web edge guidance with the sensor 23 and the servo motor 24 ensures that the change in position of the roller 12, preferably by a pivoting motion about a vertical axis respectively, controls the position of the side 25 (as shown in FIG. 2) of the film web 8 to be suitable to be gripped by the clamp 33.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A thermo-forming packaging machine comprising:

a machine frame having a first side and a second side, said machine frame aligned in a direction of transport of a film web, said film web comprising a first side and a second side; and a film advance device disposed only on said first side of said machine frame, said film advance device disposed for gripping the first side of the film web, wherein said second side of said film web is an un-gripped side of the film web, and said film advance device disposed for transporting said film web through at least a portion of said packaging machine.

2. The thermo-forming packaging machine of claim 1, further comprising a web-edge guidance device for controlling the position of said film web relative to said film advance device.

3. The thermo-forming packaging machine of claim 2, wherein said web-edge guidance device comprises a roller pivotable relative to said film advance device.

4. The thermo-forming packaging machine of claim 1, further comprising at least one film counter support for vertically supporting said film web, said film counter support disposed upstream and/or downstream of a workstation of said thermo-forming packaging machine.

5. The thermo-forming packaging machine of claim 4, further comprising a clamping device for clamping said film web against said film counter support.

6. The thermoforming packaging machine of claim 1, further comprising one or more film support members disposed at one of: a location between one or more tracks of a plurality of package trays formed in said film web, and a location proximate the un-gripped side of the film web and opposite said film advance device.

7. The thermoforming packaging machine of claim 1, further comprising an auxiliary transport device for transporting a top film, said top film provided upstream of a sealing station.

8. The thermo-forming packaging machine of claim 7, wherein said auxiliary transport device comprises a clamping chain for transporting said top film synchronously with the transport of said film web.

9. The thereto-forming packaging machine of claim 7, wherein said auxiliary transport device comprises at least one rubber roller for transporting said top film synchronously with the transport of said film web.

10. The thermo-forming packaging machine of claim 1, wherein said second side of said machine frame is open in the region of a workstation of the thermo-forming packaging machine such that one or more tools of said workstation is moveable in a direction substantially horizontally transverse to said direction of transport of said film web.

11. The thermo-forming packaging machine of claim 1, wherein said film advance device is a clamping chain.

* * * * *